US008986088B2

(12) United States Patent
Shen

(10) Patent No.: US 8,986,088 B2
(45) Date of Patent: Mar. 24, 2015

(54) NEGATIVE-PRESSURE SMOKE-GUIDING FIREPROOF BUILDING STRUCTURE

(76) Inventor: Fuchang Shen, Changzhou (CN)

( * ) Notice: Subject to any disclaimer, the term of this patent is extended or adjusted under 35 U.S.C. 154(b) by 445 days.

(21) Appl. No.: 13/257,473

(22) PCT Filed: Mar. 29, 2010

(86) PCT No.: PCT/CN2010/000394

§ 371 (c)(1),
(2), (4) Date: Sep. 19, 2011

(87) PCT Pub. No.: WO2010/115341

PCT Pub. Date: Oct. 14, 2010

(65) Prior Publication Data

US 2012/0009864 A1 Jan. 12, 2012

(30) Foreign Application Priority Data

Apr. 7, 2009 (CN) ..... 2009 1 0029217

(51) Int. Cl.

| | |
|---|---|
| ***F24F 7/00*** | (2006.01) |
| ***E04F 17/04*** | (2006.01) |
| ***E05F 1/00*** | (2006.01) |
| ***E05F 1/02*** | (2006.01) |
| ***E05F 1/10*** | (2006.01) |
| *F24F 11/00* | (2006.01) |

(52) U.S. Cl.

CPC ..... *E04F 17/04* (2013.01); *F24F 2011/0097* (2013.01); *E05F 1/006* (2013.01); *E05F 1/025* (2013.01); *E05F 1/1066* (2013.01); *E05Y 2201/50* (2013.01); *E05Y 2900/148* (2013.01); *E05Y 2201/488* (2013.01)

USPC ..... 454/357; 454/342

(58) Field of Classification Search

CPC ..... F24F 2011/0095; F24F 2011/0097; F24F 2011/0098; F24F 11/0001

USPC ..... 454/250, 342, 357

See application file for complete search history.

(56) References Cited

U.S. PATENT DOCUMENTS

| | | | | |
|---|---|---|---|---|
| 2,564,971 A * | 8/1951 | Harding | 454/342 |
| 3,337,990 A * | 8/1967 | Iwata | 49/3 |
| 3,818,816 A * | 6/1974 | Petit | 454/342 |

(Continued)

FOREIGN PATENT DOCUMENTS

| | | | |
|---|---|---|---|
| CN | 1121134 A | 4/1996 | |
| CN | 2706702 * | 6/2005 | E04F 17/02 |

(Continued)

*Primary Examiner* — Steven B McAllister
*Assistant Examiner* — Jonathan Cotov
(74) *Attorney, Agent, or Firm* — The Webb Law Firm

(57) ABSTRACT

A negative-pressure smoke-guiding fireproof building structure includes at least one vertical smoke discharge flue arranged in the building and in fluid communication with a transverse smoke discharge flue arranged in upper space of each floor. At least one natural air inlet window having a door and at least one smoke-gas discharge window having a door are arranged in a wall of each independent room off each floor. The doors normally seal the windows in a closed position and are capable of automatically opening at a fire hazard. The smoke-gas discharge window is in fluid communication with the transverse smoke discharge flue. With a simple structure, the building structure effectively prevents fire spreading to peripheral adjacent rooms when one room in the building catches fire, so as to prevent a larger fire hazard.

16 Claims, 2 Drawing Sheets

(56) References Cited

U.S. PATENT DOCUMENTS

| | | | | | |
|---|---|---|---|---|---|
| 4,054,084 | A | * | 10/1977 | Palmer | 454/342 |
| 4,068,568 | A | * | 1/1978 | Moss | 454/238 |
| 4,858,517 | A | * | 8/1989 | Coker | 454/184 |
| 4,944,216 | A | * | 7/1990 | McCutchen | 454/342 |
| 5,123,875 | A | * | 6/1992 | Eubank et al. | 454/342 |
| 5,252,030 | A | * | 10/1993 | Chikada | 417/12 |
| 5,788,571 | A | * | 8/1998 | Ivison et al. | 454/252 |
| 5,791,086 | A | * | 8/1998 | Huang | 49/7 |
| 5,855,510 | A | * | 1/1999 | McKenzie | 454/342 |
| 6,748,700 | B1 | * | 6/2004 | McAllister | 49/119 |
| 7,250,000 | B2 | * | 7/2007 | Daniels, II | 454/250 |
| 7,766,734 | B2 | * | 8/2010 | Dietz et al. | 454/345 |
| 2002/0155807 | A1 | * | 10/2002 | Moor et al. | 454/342 |
| 2004/0072538 | A1 | * | 4/2004 | Kennedy et al. | 454/342 |
| 2006/0108016 | A1 | * | 5/2006 | Funatsu et al. | 138/141 |

FOREIGN PATENT DOCUMENTS

| | | | | | |
|---|---|---|---|---|---|
| CN | 2706702 | Y | | 6/2005 | |
| CN | 2721140 | Y | | 8/2005 | |
| CN | 101519908 | A | | 9/2009 | |
| CN | 201386373 | Y | | 1/2010 | |
| DE | 202004008792 | U1 | | 9/2004 | |
| GB | 1414682 | | | 11/1975 | |
| GB | 2140077 | A | * | 11/1984 | E05F 11/28 |

* cited by examiner

NEGATIVE-PRESSURE SMOKE-GUIDING FIREPROOF BUILDING STRUCTURE

BACKGROUND OF THE INVENTION

1. Field of Invention

The present invention relates to a fireproof building structure, in particular, to a fireproof building structure in which a vertical smoke discharge flue and a transverse smoke discharge flue are arranged for negative-pressure smoke guiding.

2. Related Art

Currently there are two kinds of fireproof building structures. In the first kind of fireproof building structure, an exit passageway is arranged in the building; closets for storing fire-fighting equipment are arranged at each floor; and spraying facilities are arranged in corridors and rooms of each floor for fire preventing and fire extinguishing. However, in the real situation when a fire occurs to the building, once a room in the building catches fire, the best time for fire extinguishing is usually delayed due to slow response or failure of a smoke or temperature sensor of the spraying facility arranged in the room. And once the flames turn into a big fire, the spraying facility is usually incapable of extinguishing the fire. At the time, the fire, smoke and hazardous gases begin to spread into all directions from the room on fire, so that rooms, around and up and down the floor, catch fire one after another, thereby causing a larger fire hazard. Besides, it is difficult for on-site people to find the fire-fighting equipment to extinguish the fire because the floor corridor, the staircase passage, and the exit passageway are all filled with smoke; and the on-site people are likely to be suffocated and poisoned to death due to severe oxygen starvation and inhalation of hazardous gases, thereby causing a great number of injuries and property loss. Furthermore, in some residential buildings, no fire-fighting equipment or spraying facilities are arranged in the corridors or rooms thereof, and therefore, when one house catches fire, the fire may spread more quickly to the houses around and up and down the floor, thereby causing much more damage. The second kind of fireproof building structure is a structure provided by Chinese Utility Model No. 200420040584.7, entitled INDUCED-DRAFT SMOKE-DISCAHRGE SAFETY FIREPROOF DEVICE, in which a vertical smoke discharge flue is respectively arranged at both sides of the corridor of the building; a transverse smoke discharge flue with a smoke discharge door is arranged in the upper part of each floor corridor; the vertical smoke discharge flues at both sides are in communication with the transverse smoke discharge flue; a DC electromagnetic lock is arranged on the smoke discharge door; and a natural air inlet window is arranged in the wall at the bottom of the building; furthermore, in large public activity places at each floor of the building, in order to enhance smoke discharge of such a large space, an electric induced draft fan and a burner are respectively arranged at the top of the two vertical smoke discharge flues. When a fire breaks out in a building of this structure, a smoke temperature detector, after detecting the smoke and gases, sends an electrical signal to an electrical control device to open the smoke discharge door of the transverse smoke discharge flue, so that the high-temperature smoke and gases, according to law of nature, rise through the smoke discharge door into the transverse smoke discharge flue and the vertical smoke discharge flues, and then is released upwards into the atmosphere. If the induced draft fan and the burner are used in the vertical smoke discharge flues, a better smoke discharge effect can be achieved. The fireproof building of this structure may have good negative-pressure smoke-guiding effect, but still has disadvantages as follows. On one hand, the smoke discharge door is arranged on the transverse smoke discharge flue, and therefore, only after the smoke enters the corridor and is in such a great concentration as to be detected by the smoke temperature detector and to enable the electrical control device to trigger the smoke discharge door, the negative-pressure smoke guiding can be achieved. However, when one room in the building is on fire, firstly peripheral adjacent rooms are often caused on fire one after another; then, after the doors of the rooms on fire are burnt down, the smoke and gas may enter the corridors in great number and the negative-pressure smoke-guiding structure in the building can work. However, at the time, various rooms at the same or adjacent floors are burnt down, causing a great deal of loss. Besides, if the room door is steel structure and difficult to be burnt down, the smoke and gas cannot enter the corridor in great number, and therefore, the smoke temperature detector is incapable of detecting the smoke and gas and enabling the electrical control device to trigger the smoke discharge door to open. At the time, the negative-pressure smoke-guiding structure in the building is ineffective, therefore causing much more loss. Furthermore, the smoke discharge door can be opened only if the electrical control device is connected to the DC electromagnetic lock. However, the electrical control device and the DC electromagnetic lock may easily be damaged or fail in the high-temperature environment of the fire scene.

Therefore, the smoke discharge door usually cannot be opened, and the smoke and gas cannot enter the transverse smoke discharge flue, so that the negative-pressure smoke-guiding structure becomes ineffective. On the other hand, the natural air inlet window is arranged in the wall at the bottom of the building, when one or some rooms in the building are on fire, the natural air inlet window is usually incapable of timely introducing fresh air from the outside due to a long distance or obstruction of the floors, to lower the temperature of the fire scene and to improve the air quality. Therefore a desirable using effect thereof cannot be achieved.

SUMMARY OF THE INVENTION

Accordingly the present invention is directed to a negative-pressure smoke-guiding fireproof building structure, which, with a simple structure, effectively preventing fire from spreading from one room on fire in the building to peripheral adjacent rooms, thereby controlling the fire within the minimum range and preventing occurrence of a larger fire hazard.

In order to solve the above technical problems, the present invention provides a negative-pressure smoke-guiding fireproof building structure, including at least one vertical smoke discharge flue arranged in the building and a transverse smoke discharge flue arranged in upper space of each floor. The vertical smoke discharge flue is in fluid communication with the transverse smoke discharge flue. At least one natural air inlet window and at least one smoke-gas discharge window are arranged in a wall of each independent room of each floor. The natural air inlet window consists of an air inlet window, an air inlet window door capable of sealing the air inlet window in the normal state, and an air inlet window door opening mechanism capable of automatically opening the air inlet window at a fire hazard. The smoke-gas discharge window consists of a smoke discharge window, a smoke discharge window door capable of sealing the smoke discharge window in the normal state, and a smoke discharge window door opening mechanism capable of automatically opening the smoke discharge window at a fire hazard. The smoke-gas discharge window is in fluid communication with the transverse smoke discharge flue.

The air inlet window door opening mechanism may consist of an air inlet window door balancing weight and a hot-melt adhesive. The air inlet window door balancing weight is fixed to an upper end of the air inlet window door. A lower end of the air inlet window door is hinged with a bottom of the air inlet window. The air inlet window door is sealed with the air inlet window through the hot-melt adhesive. After adopting this kind of structure, the hot-melt adhesive has a low melting point, and when there is a fire, the indoor temperature may reach hundreds of degrees, or even over 1000 degrees, which is far higher than the melting temperature of the hot-melt adhesive. Therefore, the hot-melt adhesive melts firstly when there is a fire, so that the air inlet window door is rotated around the bottom of the air inlet window under the action of the gravity of the air inlet window door balancing weight, thereby opening the air inlet window. The opening mechanism of the structure is not only simple, but also reliable.

The air inlet window door opening mechanism may also consist of an extension spring and a hot-melt adhesive. Two ends of the extension spring are respectively fixed to the upper end of the air inlet window door and to the bottom of the air inlet window, and the extension spring is in an extension state. The lower end of the air inlet window door is hinged with the bottom of the air inlet window. The air inlet window door is sealed with the air inlet window through the hot-melt adhesive. After adopting this kind of structure, as the hot-melt adhesive firstly melts at a fire hazard, the air inlet window door is rotated around the bottom of the air inlet window under the action of the retraction force of the extension spring, thereby opening the air inlet window. The opening mechanism of the structure is also simple and reliable.

The air inlet window door opening mechanism may further consist of a hot-melt adhesive. The upper end of the air inlet window door leans towards the inside or outside of the air inlet window, and the lower end of the air inlet window door is hinged with the bottom of the air inlet window. The air inlet window door is sealed with the air inlet window through the hot-melt adhesive. After adopting this kind of structure, as the hot-melt adhesive firstly melts at a fire hazard, and as the air inlet window door leans towards the inside or outside of the air inlet window, the air inlet window door is rotated around the bottom of the air inlet window under the action of the gravity of the air inlet window door, thereby opening the air inlet window. The opening mechanism of the structure is simpler and more reliable.

The smoke discharge window door opening mechanism may consist of a smoke discharge window door balancing weight and a hot-melt adhesive. The smoke discharge window door balancing weight is fixed to an upper end of the smoke discharge window door. A lower end of the smoke discharge window door is hinged with a bottom of the smoke discharge window. The smoke discharge window door is sealed with the smoke discharge window through the hot-melt adhesive. This kind of smoke discharge window door opening mechanism has a simple and reliable structure.

The smoke discharge window door opening mechanism may also consist of an extension spring and a hot-melt adhesive. Two ends of the extension spring are respectively fixed to the upper end of the smoke discharge window door and to the bottom of the smoke discharge window, and the extension spring is in an extension state. The lower end of the smoke discharge window door is hinged with the bottom of the smoke discharge window. The smoke discharge window door is sealed with the smoke discharge window through the hot-melt adhesive. This kind of smoke discharge window door opening mechanism also has a simple and reliable structure.

After adopting this kind of structure, as at least one natural air inlet window and at least one smoke-gas discharge window are arranged in the wall of each independent room of each floor in the building, and the smoke-gas discharge window is in fluid communication with the transverse smoke discharge flue, once one room catches fire accidentally, the air inlet window and the smoke discharge window can be immediately opened in time respectively through the air inlet window door opening mechanism and the smoke discharge window door opening mechanism, so that the high-temperature smoke and flames enter the transverse smoke discharge flue and the vertical smoke discharge flue through the smoke-gas discharge window, and then is released upwards into the atmosphere under the action of negative pressure. At the same time, the natural air inlet window continuously introduces colder fresh air from the outside into the room to lower the temperature of the fire scene and improve the indoor environment. It can be seen that when one room in the building catches fire accidentally, high-temperature smoke and flames generated in the room can be timely released into the atmosphere outside the building through the smoke-gas discharge window; at the same time, the colder fresh air is introduced into the room from the outside to lower the temperature of the fire scene, so that the fire is prevented from spreading to peripheral adjacent rooms, thereby controlling the fire within the room and effectively preventing occurrence of a larger fire hazard.

As an improvement to the present invention, an induced draft fan is further arranged in the smoke-gas discharge window. A trigger of the induced draft fan is fixed to one end of a rope, and the other end of the rope is fixed to the smoke discharge window door. After adopting this kind of structure, when the smoke discharge window door is rotated at a fire hazard, the induced draft fan is started by pulling the trigger through the rope. The high-temperature smoke and gases are forcibly introduced into the smoke-gas discharge window by the induced draft fan and finally released into the atmosphere, and therefore, the structure has a better smoke-guiding effect.

As a further improvement to the present invention, the melting range of the hot-melt adhesive is 55° C. to 100° C. and any one of paraffin wax, rosin, ethylene-vinyl acetate copolymer hot-melt adhesive, polyamide hot-melt adhesive, or polyurethane hot-melt adhesive. The paraffin wax begins to melt at about 58° C., and the melting range of the ethylene-vinyl acetate copolymer hot-melt adhesive, the polyamide hot-melt adhesive, or the polyurethane hot-melt adhesive is 65° C. to 100° C., and therefore, the hot-melt adhesive melts quickly at a fire hazard and has a reliable performance and a low cost.

As a further improvement to the present invention, there are two such vertical smoke discharge flues, respectively arranged on both sides of an exit passageway in the building. Adopting this kind of structure, on one hand, has no influence on the usable space of the building; and on the other hand, the structure is convenient for the smoke guidance and smoke discharge of the rooms at two lateral sides of the building.

As another improvement to the present invention, there are four such vertical smoke discharge flues, in which two are respectively arranged on both sides of the exit passageway in the building; and the other two are respectively arranged on lateral outer sides of the building. Adopting this kind of structure, a better smoke-guiding and discharging effect can be achieved.

BRIEF DESCRIPTION OF THE DRAWINGS

The specific embodiments of the present invention are further described hereinafter in detail with reference to the accompanying drawings.

DETAILED DESCRIPTION OF THE EMBODIMENTS

Figure 1:
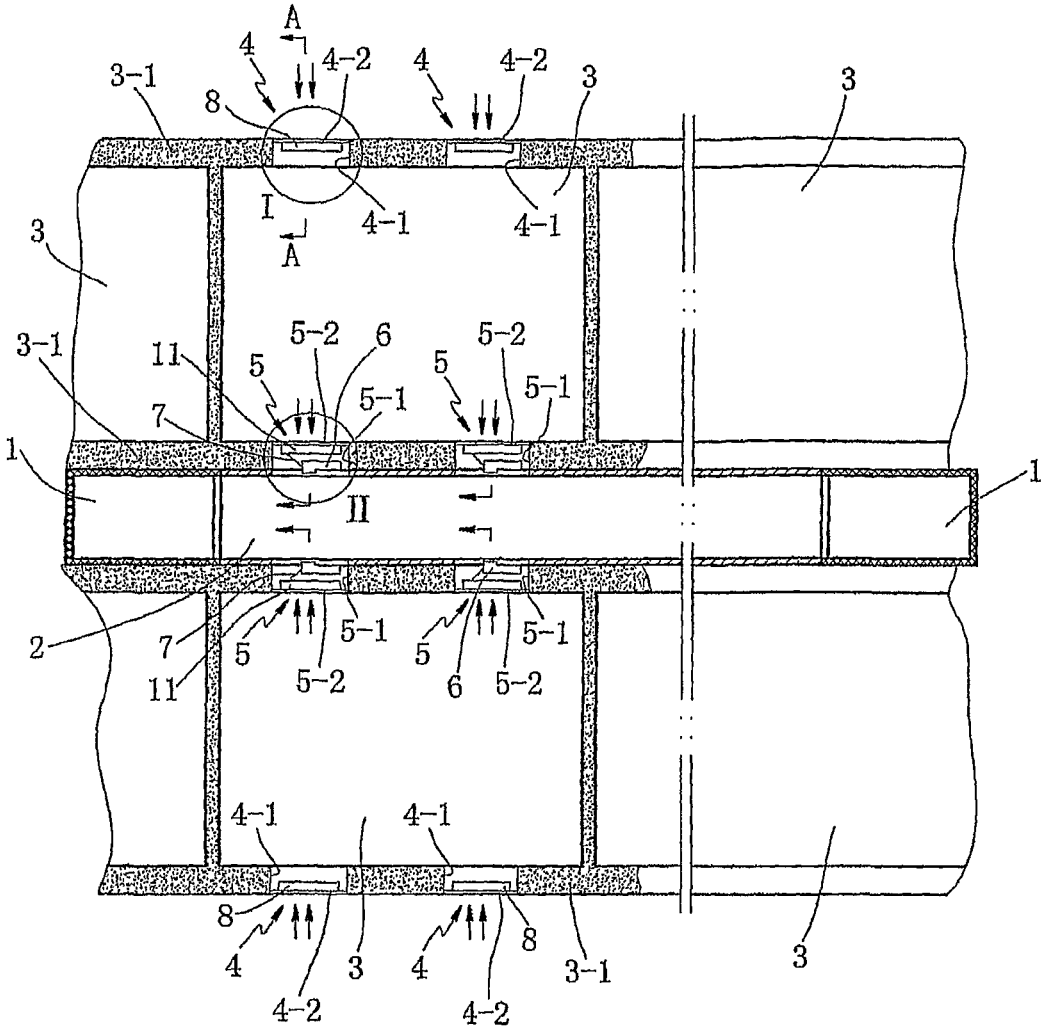
FIG. 1 is a partial cross-sectional schematic view of an embodiment of a negative-pressure smoke-guiding fireproof building structure according to the present invention.

As shown in FIG. 1 to FIG. 6, a negative-pressure smoke-guiding fireproof building structure includes at least one vertical smoke discharge flue 1 arranged in the building and a transverse smoke discharge flue 2 arranged in upper space of each floor in the building. The vertical smoke discharge flue 1 is in fluid communication with the transverse smoke discharge flue 2. At least one natural air inlet window 4 and at least one smoke-gas discharge window 5 are arranged in a wall 3-1 of each independent room 3 of each floor in the building. As shown in FIG. 1, there are respectively two such natural air inlet windows 4 and two such smoke-gas discharge windows 5. Of course, the number of the natural air inlet window 4 and the smoke-gas discharge window 5 may be three, four or even more according to the size of the room 3. The natural air inlet window 4 consists of an air inlet window 4-1, an air inlet window door 4-2 capable of sealing the air inlet window 4-1 in the normal state or closed position, and an air inlet window door opening mechanism capable of automatically opening the air inlet window 4-1 at a fire hazard. The smoke-gas discharge window 5 consists of a smoke discharge window 5-1, a smoke discharge window door 5-2 capable of sealing the smoke discharge window 5-1 in the normal state or closed position, and a smoke discharge window door opening mechanism capable of automatically opening the smoke discharge window 5-1 at a fire hazard. The smoke-gas discharge window 5 is in fluid communication with the transverse smoke discharge flue 2.

When the room 3 catches fire accidentally, in order to guide the smoke more quickly and effectively, an induced draft fan 6 is arranged in the smoke-gas discharge window 5. As shown in FIG. 1, a trigger of the induced draft fan 6 is fixed to one end of a rope 7, and the other end of the rope 7 is fixed to the smoke discharge window door 5-2. Therefore, when the smoke discharge window door 5-2 is rotated, the rope 7 pulls the trigger of the induced draft fan 6 so that the induced draft fan is connected to the power supply and starts to guide the smoke. The induced draft fan 6 may be driven by a well-known DC power supply, and of course, may be driven by an AC or an AC-DC power supply. The induced draft fan 6 may use burnable materials such as plastics. In this way, at the initial stage of the fire hazard, the induced draft fan may complete the initial smoke guidance since the temperature of the smoke and gas is not high, and then is burnt down by the smoke and flames of increasingly high temperature, thereby enabling the smoke-gas discharge window smoother.

Figure 2:
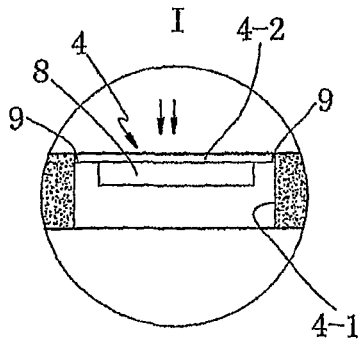
FIG. 2 is an amplified schematic view of location I shown in FIG. 1.
Figure 3:
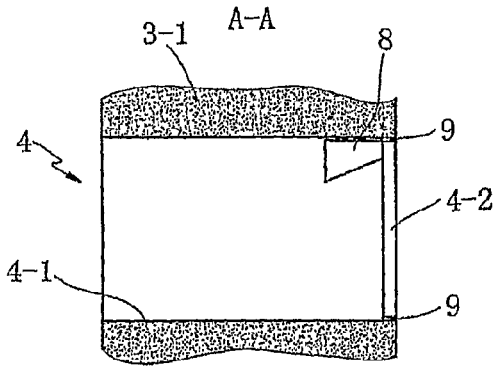
FIG. 3 is a cross-sectional schematic view of an embodiment along line A-A in FIG. 1.

Referring to FIG. 2 and FIG. 3, the air inlet window door opening mechanism may consist of an air inlet window door balancing weight 8 and a hot-melt adhesive 9. The air inlet window door balancing weight 8 is fixed to an upper end of the air inlet window door 4-2. A lower end of the air inlet window door 4-2 is hinged with a bottom of the air inlet window 4-1. The air inlet window door 4-2 includes at least one edge portion that is positioned adjacent to a portion of the wall 3-1 defining the air inlet window 4-1 and is sealed with the air inlet window 4-1 through the hot-melt adhesive 9. The hot-melt adhesive 9 is located between the portion of the wall 3-1 defining the air inlet window 4-1 and the adjacently disposed at least one edge portion of the air inlet window door 4-2 to directly seal the air inlet window door to the wall portion.

Figure 4:
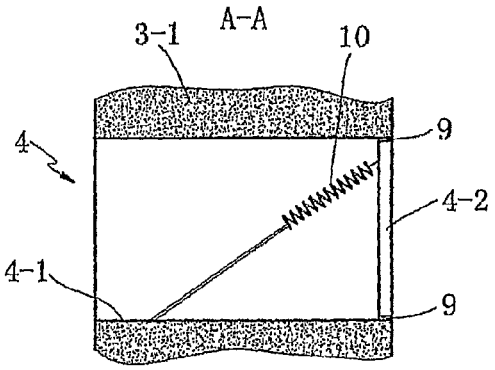
FIG. 4 is a cross-sectional schematic view of another embodiment along line A-A in FIG. 1.

Referring to FIG. 4, the air inlet window door opening mechanism may consist of an extension spring 10 and the hot-melt adhesive 9. The two ends of the extension spring 10 are respectively fixed to the upper end of the air inlet window door 4-2 and the bottom of the air inlet window 4-1, and the extension spring is in an extension state. The lower end of the air inlet window door 4-2 is hinged with the bottom of the air inlet window 4-1. The air inlet window door 4-2 is sealed with the air inlet window 4-1 through the hot-melt adhesive.

Figure 5:
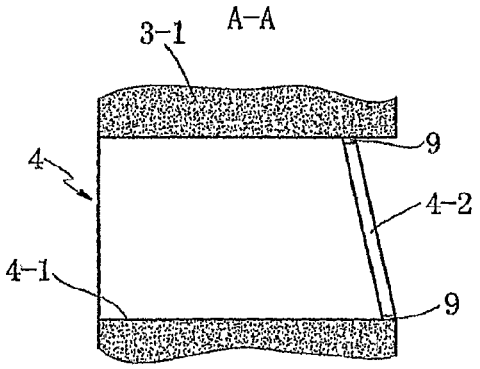
FIG. 5 is a cross-sectional schematic view of still another embodiment along line A-A in FIG. 1.

Referring to FIG. 5, the air inlet window door opening mechanism may further consist of the hot-melt adhesive 9. The upper end of the air inlet window door 4-2 leans towards inside or outside of the air inlet window 4-1, as shown in FIG. 5, the upper end of the air inlet window door 4-2 leans towards the inside, and the lower end of the air inlet window door 4-2 is hinged with the bottom of the air inlet window 4-1. The air inlet window door 4-2 is sealed with the air inlet window 4-1 through the hot-melt adhesive 9. Therefore, when the room 3 catches fire accidentally, as the hot-melt adhesive firstly melts at a fire hazard, the air inlet window door is rotates inward or outward around the bottom of the air inlet window under the action of the gravity of the air inlet window door, thereby opening the air inlet window. Of course, the air inlet window door opening mechanism may also adopt other well-known structures.

Figure 6:
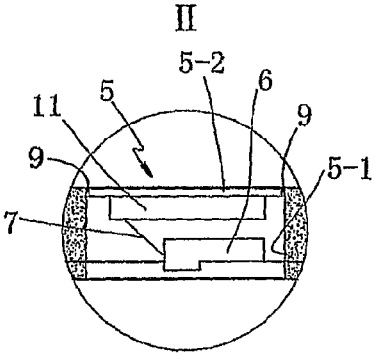
FIG. 6 is an amplified schematic view of location II shown in FIG. 1.

Referring to FIG. 1 and FIG. 6, the smoke discharge window door opening mechanism may consist of a smoke discharge window door balancing weight 11 and the hot-melt adhesive 9. The smoke discharge window door balancing weight 11 is fixed to an upper end of the smoke discharge window door 5-2. A lower end of the smoke discharge window door 5-2 is hinged with a bottom of the smoke discharge window 5-1. The smoke discharge window door 5-2 is sealed with the smoke discharge window 5-1 through the hot-melt adhesive 9.

The smoke discharge window door opening mechanism may also consist of an extension spring and the hot-melt adhesive 9. Two ends of the extension spring are respectively fixed to the upper end of the smoke discharge window door 5-2 and to the bottom of the smoke discharge window 5-1, and the extension spring is in an extension state. The lower end of the smoke discharge window door 5-2 is hinged with the bottom of the smoke discharge window 5-1. The smoke discharge window door 5-2 is sealed with the smoke discharge window 5-1 through the hot-melt adhesive 9. The smoke discharge window door opening mechanism is not shown and may be referred to the air inlet window door opening mechanism shown in FIG. 4. The smoke discharge window door opening mechanism may also consist of the hot-melt adhesive 9. The upper end of the smoke discharge window door 5-2 leans toward the inside or outside of the smoke discharge window 5-1, and the lower end of the smoke discharge window door 5-2 is hinged with the bottom of the smoke discharge window 5-1. The smoke discharge window door 5-2 is sealed with the smoke discharge window 5-1 through the hot-melt adhesive 9. The smoke discharge window door opening mechanism is not shown and may be referred to FIG.

5. Of course, the smoke discharge window door opening mechanism can also adopt other well-known structures.

The melting range of the hot-melt adhesive is 55° C. to 100° C. It is preferred that the hot-melt adhesive is any one of paraffin wax, rosin, asphalt, ethylene-vinyl acetate copolymer hot-melt adhesive, polyamide hot-melt adhesive, polyurethane hot-melt adhesive, and polyester hot-melt adhesive. In the present invention, the paraffin wax is preferred. The paraffin wax begins to melt at about 58° C. and the melting range of the ethylene-vinyl acetate copolymer hot-melt adhesive, the polyamide hot-melt adhesive, the polyurethane hot-melt adhesive or the polyester hot-melt adhesive is 65° C. to 100° C., and therefore, the hot-melt adhesive melts quickly at a fire hazard and has a reliable performance and a low cost.

In the present invention, there may be two such vertical smoke discharge flues 1, respectively arranged on both sides of an exit passageway of the building, as shown in FIG. 1.

In the present invention, there may be four such vertical smoke discharge flues 1, in which two of the vertical smoke discharge flues 1 are respectively arranged on both sides of the exit passageway of the building, and the other two of the vertical smoke discharge flues 1 are respectively arranged on lateral outer sides of the building, which is not shown.

When one independent room 3 in the building according to the present invention catches fire accidentally, the temperature of the indoor smoke and flames is higher than the melting temperature of the hot-melt adhesive, and the paraffin wax is preferred in the present invention. In this way, the paraffin wax firstly melts, and the air inlet window door 4-2 is rotated around the bottom of the air inlet window 4-1 under the action of the air inlet window door balancing weight 8 or the extension spring 10 or the gravity of the air inlet window door 4-2, thereby opening the air inlet window 4-1. Similarly, the smoke discharge window door 5-2 is rotated around the bottom of the smoke discharge window 5-1 under the action of the smoke discharge window door balancing weight 11 or the extension spring or the gravity of the smoke discharge window door 5-2, thereby opening the smoke discharge window 5-1. In this way, the high-temperature smoke and flames in the room enter the transverse smoke discharge flue 2 and the vertical smoke discharge flue 1 through the smoke discharge window 5-1, and then is released into the atmosphere outside the building. When the induced draft fan 6 is arranged in the smoke-gas discharge window 5, a better smoke-guiding effect may be achieved. At the same time, the natural air inlet window continuously introduces colder outdoor fresh air into the room, so as to lower the temperature of the fire scene, improve the indoor environment, and prevent the smoke and flames from spreading to peripheral adjacent rooms, thereby controlling the fire within the room and effectively preventing the occurrence of a larger fire hazard.

Only preferred embodiments of the present invention are described above. It should be pointed out that any modifications and improvements made by persons of ordinary skills in the art without departing from the principle of the present invention should fall within the protection scope of the present invention.

What is claimed is:

1. A negative-pressure smoke-guiding fireproof building structure, comprising:

at least one vertical smoke discharge flue arranged in the building and a transverse smoke discharge flue arranged in an upper space of each floor in the building, the vertical smoke discharge flue being in fluid communication with the transverse smoke discharge flue wherein at least one natural air inlet window and at least one smoke-gas discharge window are arranged in a wall of each independent room of each floor in the building, wherein the natural air inlet window consists of an air inlet window, an air inlet window door capable of sealing the air inlet window in a closed position, said air inlet window door having a lower end which is hinged with a bottom of the air inlet window, and an air inlet window door opening mechanism capable of automatically opening the air inlet window at a fire hazard, said air inlet window door opening mechanism including a hot-melt adhesive for directly sealing the air inlet window door in the closed position, wherein the smoke-gas discharge window consists of a smoke discharge window, a smoke discharge window door capable of sealing the smoke discharge window in the normal state, and a smoke discharge window door opening mechanism capable of automatically opening the smoke discharge window at a fire hazard, and wherein the smoke-gas discharge window is in fluid communication with the transverse smoke discharge flue.

2. The negative-pressure smoke-guiding fireproof building structure according to claim 1, wherein the air inlet window door opening mechanism includes an air inlet window door balancing weight and the hot-melt adhesive, and wherein the air inlet window door balancing weight is fixed to an upper end of the air inlet window door and the air inlet window door is sealed with the air inlet window via the hot-melt adhesive.

3. The negative-pressure smoke-guiding fireproof building structure according to claim 1, wherein the air inlet window door opening mechanism includes an extension spring and the hot-melt adhesive, wherein the extension spring has two ends respectively fixed to an upper end of the air inlet window door and a bottom of the air inlet window, and is in an extension state, and wherein the air inlet window door is sealed with the air inlet window via the hot-melt adhesive.

4. The negative-pressure smoke-guiding fireproof building structure according to claim 1, wherein the air inlet window door opening mechanism comprises the hot-melt adhesive, wherein an upper end of the air inlet window door leans towards the inside or outside of the air inlet window, and wherein the air inlet window door is sealed with the air inlet window via the hot-melt adhesive.

5. The negative-pressure smoke-guiding fireproof building structure according to claim 1, wherein the smoke discharge window door opening mechanism includes a smoke discharge window door balancing weight and a hot-melt adhesive, the smoke discharge window door balancing weight is fixed to an upper end of the smoke discharge window door, a lower end of the smoke discharge window door is hinged with a bottom of the smoke discharge window, and the smoke discharge window door is sealed with the smoke discharge window via the hot-melt adhesive.

6. The negative-pressure smoke-guiding fireproof building structure according to claim 1, wherein the smoke discharge window door opening mechanism includes an extension spring and a hot-melt adhesive, the extension spring has two ends respectively fixed to an upper end of the smoke discharge window door and a bottom of the smoke discharge window and is in an extension state, a lower end of the smoke discharge window door is hinged with the bottom of the smoke discharge window, and the smoke discharge window door is sealed with the smoke discharge window via the hot-melt adhesive.

7. The negative-pressure smoke-guiding fireproof building structure according to claim 1, wherein an induced draft fan is further arranged in the smoke-gas discharge window, a trigger of the induced draft fan is fixed to one end of a rope, and the other end of the rope is fixed to the smoke discharge window door.

8. The negative-pressure smoke-guiding fireproof building structure according to claim 2, wherein the hot-melt adhesive has a melting range of 55° C. to 100° C. and is any one of paraffin wax, rosin, ethylene-vinyl acetate copolymer hot-melt adhesive, polyamide hot-melt adhesive, and polyurethane hot-melt adhesive.

9. The negative-pressure smoke-guiding building structure according to claim 1, comprising: two vertical smoke discharge flues respectively arranged on both sides of an exit passageway of the building.

10. The negative-pressure smoke-guiding building structure according to claim 1, comprising: four vertical smoke discharge flues, wherein two of the vertical smoke discharge flues are respectively arranged on both sides of an exit passageway of the building, and the other two of the vertical smoke discharge flues are respectively arranged on lateral outer sides of the building.

11. The negative-pressure smoke-guiding building structure according to claim 1, wherein the air inlet window door includes at least one edge portion positioned adjacent to a wall portion defining the air inlet window and the hot-melt adhesive is located between the wall portion defining the air inlet window and the adjacently disposed at least one edge portion of the air inlet window door to directly seal the air inlet window door to the wall portion.

12. A negative-pressure smoke-guiding fireproof building structure, comprising:

at least one vertical smoke discharge flue arranged in the building and a transverse smoke discharge flue arranged in an upper space of each floor in the building, the vertical smoke discharge flue being in fluid communication with the transverse smoke discharge flue, wherein at least one natural air inlet window and at least one smoke-gas discharge window are arranged in a wall of each independent room of each floor in the building, wherein the natural air inlet window consists of an air inlet window, an air inlet window door having a lower end hinged to a bottom of the air inlet window and capable of sealing the air inlet window in a closed position, and an air inlet window door opening mechanism capable of automatically opening the air inlet window at a fire hazard, wherein the smoke-gas discharge window consists of a smoke discharge window, a smoke discharge window door capable of sealing the smoke discharge window in a closed position, and a smoke discharge window door opening mechanism capable of automatically opening the smoke discharge window at a fire hazard, and wherein the smoke-gas discharge window is in fluid communication with the transverse smoke discharge flue and an induced draft fan arranged in the smoke-gas discharge window.

13. The negative-pressure smoke-guiding fireproof building structure according to claim 12, including a trigger for the induced draft fan, said trigger fixed to one end of a rope and the other end of the rope fixed to the smoke discharge window door.

14. The negative-pressure smoke-guiding fireproof building structure according to claim 13, wherein the rope is configured to pull the trigger of the induced draft fan when the smoke discharge window door is rotated to activate the induced draft fan to guide the smoke out of the building.

15. The negative-pressure smoke-guiding fireproof building structure according to claim 12, wherein the induced draft fan is positioned to cooperate with the introduction of fresh air into the room from the air inlet window to control the fire within the room.

16. The negative-pressure smoke-guiding fireproof building structure according to claim 12, wherein the induced draft fan is formed from burnable materials.

* * * * *